US006883719B2

(12) United States Patent
Pyrce

(10) Patent No.: US 6,883,719 B2
(45) Date of Patent: Apr. 26, 2005

(54) TOY TRACK AND METHOD OF ASSEMBLING AND DISASSEMBLING THE SAME

(75) Inventor: Philip R. Pyrce, Amherst, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/285,698

(22) Filed: Nov. 1, 2002

(65) Prior Publication Data

US 2004/0084545 A1 May 6, 2004

(51) Int. Cl.[7] ..... E01B 23/00
(52) U.S. Cl. ..... 238/10 B
(58) Field of Search ..... 238/10 R, 10 A, 238/10 B, 10 C, 10 E, 10 F

(56) References Cited

U.S. PATENT DOCUMENTS

| | | | | |
|---|---|---|---|---|
| 2,031,194 A | | 2/1936 | Thompson | |
| 2,534,458 A | * | 12/1950 | Larrabee | 238/10 R |
| 2,764,357 A | * | 9/1956 | Katryniak | 238/10 R |
| 4,066,211 A | * | 1/1978 | Mak | 238/10 F |
| 4,084,746 A | | 4/1978 | Cheng | |
| 4,091,995 A | | 5/1978 | Barlow et al. | |
| 4,106,695 A | | 8/1978 | Carella et al. | |
| 4,179,066 A | | 12/1979 | Teter | |
| 4,219,153 A | | 8/1980 | Cheng | |
| D281,002 S | | 10/1985 | Olsen | |
| 4,544,094 A | | 10/1985 | Scholey | |
| D281,443 S | | 11/1985 | Olsen | |
| 4,550,910 A | | 11/1985 | Goldfarb et al. | |
| 4,898,326 A | * | 2/1990 | Edwards et al. | 238/10 E |
| 4,953,785 A | | 9/1990 | Keska | |
| D325,057 S | | 3/1992 | Plagborg | |
| 5,154,346 A | | 10/1992 | Bruning | |
| 5,222,902 A | | 6/1993 | Piersch | |
| 5,405,080 A | | 4/1995 | Yeung et al. | |
| 5,503,330 A | | 4/1996 | Riley | |
| 5,577,448 A | | 11/1996 | Leung | |
| 5,579,997 A | | 12/1996 | Jackson et al. | |
| D382,607 S | | 8/1997 | Riley | |
| 5,752,678 A | | 5/1998 | Riley | |
| 5,791,253 A | | 8/1998 | Schultheis et al. | |
| 5,794,846 A | | 8/1998 | Barrett | |
| 5,826,835 A | | 10/1998 | Wilson et al. | |
| 5,890,948 A | | 4/1999 | Nilsson | |
| D414,531 S | | 9/1999 | Rudy | |
| D421,281 S | | 2/2000 | Riley | |
| 6,019,289 A | | 2/2000 | Sung | |
| 6,123,298 A | | 9/2000 | Riley | |
| 6,250,986 B1 | | 6/2001 | Sorensen | |
| 6,299,072 B1 | | 10/2001 | Burns | |
| 6,328,500 B1 | | 12/2001 | Rubio | |
| 6,398,121 B1 | * | 6/2002 | Morgan | 238/10 F |
| 6,427,926 B1 | | 8/2002 | Lai | |

FOREIGN PATENT DOCUMENTS

| | | |
|---|---|---|
| EP | 0 014 162 A1 | 8/1980 |
| GB | 718825 | 11/1954 |
| GB | 2 099 317 A | 12/1982 |

* cited by examiner

*Primary Examiner*—Mark T. Le
(74) *Attorney, Agent, or Firm*—Cooley Godward LLP

(57) ABSTRACT

A track section includes a body having a coupling portion. In one embodiment, the coupling portion includes a projection extends outwardly from the coupling portion and a recess extending inwardly into the coupling portion. In one embodiment, the recess extends downwardly through the coupling portion. In another embodiment, the recess extends from an upper surface of the body to a lower surface of the body.

8 Claims, 7 Drawing Sheets

TOY TRACK AND METHOD OF ASSEMBLING AND DISASSEMBLING THE SAME

BACKGROUND OF THE INVENTION

The present invention relates generally to a toy track, and more particularly, to a coupling portion of a toy track section.

Conventional toy track sections are limited in the ways that they can be coupled together. Some conventional toy track sections include couplers that enable the track sections to be coupled to another track section. Such track sections are limited in the directions in which the track sections can be coupled together.

A need exists for a track section that can be easily coupled to another track section. A need also exists for a track section that can be coupled to another track section in different directions.

SUMMARY OF THE INVENTION

The present invention relates a track section that includes a body having a coupling portion. In one embodiment, the coupling portion includes a projection that extends outwardly from the coupling portion and a recess that extends inwardly into the coupling portion. In one embodiment, the recess extends downwardly through the coupling portion. In another embodiment, the recess extends from an upper surface of the body to a lower surface of the body.

In one embodiment, the coupling portion of a first track section can be coupled to the coupling portion of a second track section. In one embodiment, a projection on the first track section can be coupled to a recess on the second track section. In another embodiment, a projection on the second track section can be coupled to a recess on the first track section.

DETAILED DESCRIPTION OF THE INVENTION

The present invention relates a track section that includes a body having a coupling portion. In one embodiment, the coupling portion includes a projection that extends outwardly from the coupling portion and a recess that extends inwardly into the coupling portion. In one embodiment, the recess extends downwardly through the coupling portion. In another embodiment, the recess extends from an upper surface of the body to a lower surface of the body.

In one embodiment, the coupling portion of a first track section can be coupled to the coupling portion of a second track section. In one embodiment, a projection on the first track section can be coupled to a recess on the second track section. In another embodiment, a projection on the second track section can be coupled to a recess on the first track section.

Figure 1A:
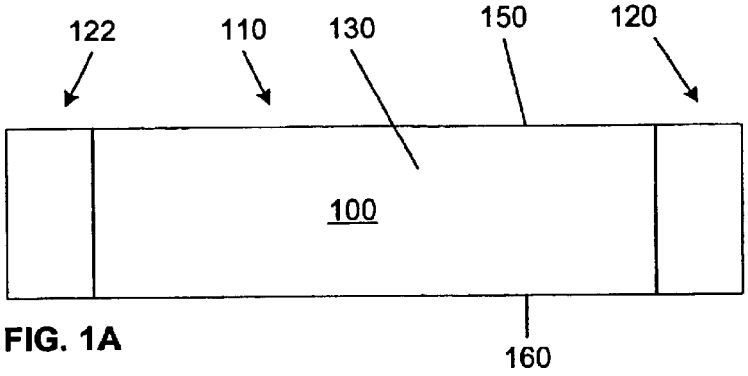
FIGS. 1A–1C are schematic top, side, and end views of a track section according to the invention.
Figure 1B:
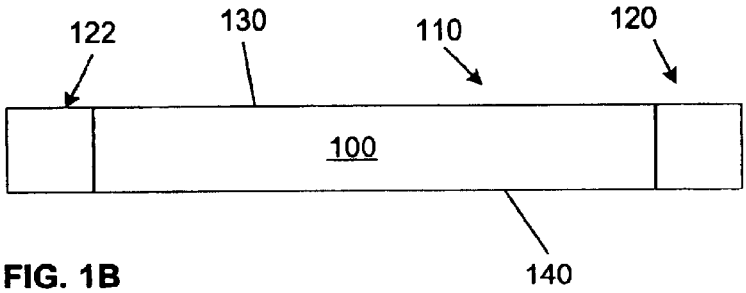
Figure 1C:
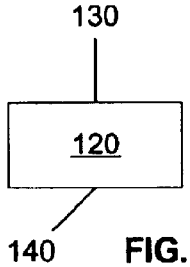

A track section or track element 100 embodying the principles of the invention is illustrated schematically in FIGS. 1A–1C. Track section 100 has a body portion 10 and a coupling portion 120 at one end of track section 100. The other end of track section 100 may include another coupling portion (such as 122), identical to coupling portion 120, or may include a coupler of other geometry, or no coupler. Track section 100 also has an upper surface 130 that extends across body portion 110 and coupling portion 120, a bottom surface 140, and lateral side walls 150 and 160 that extend between the upper and lower surfaces 130 and 140.

Upper surface 130 may be planar or non-planar (e.g. arcuate), and may be configured to resemble a railroad track, a roadway, a canal, or other transportation medium. Alternatively, the upper surface 130 can be configured to resemble or simulate any other surface. Lower surface 140 may be of any shape or configuration suitable for supporting track section 110 on a supporting surface, which can be a planar surface such as a floor or table top. Thus the lower surface 140, or portions thereof, may define a support plane so that track section 100 can be stably supported on a planar support surface. Lower surface 140 may also be configured in any of the same ways as upper surface 130. Upper surface 130 can be configured to provide the supporting function of the lower surface 140 so that the track section 100 may be used with either surface resting on the supporting surface and the other surface facing upwardly. Although shown in this and other embodiments as being linear, track section 100 may also be arcuate or of any other desired shape.

Figure 2:
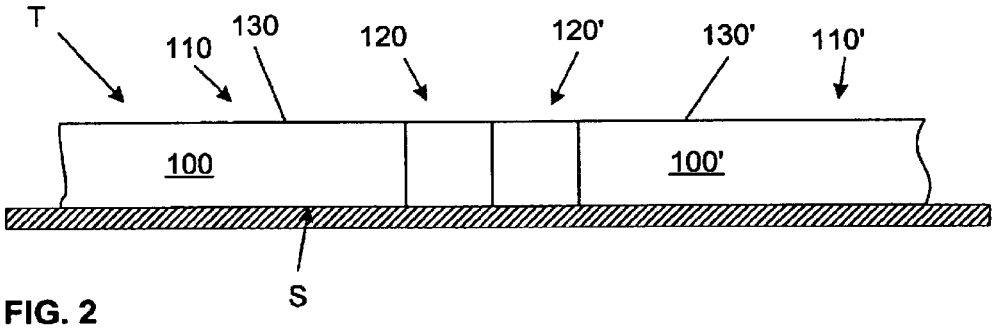
FIG. 2 is a schematic side view of the track section of FIGS. 1A–1C coupled to another track section.

As illustrated schematically in FIG. 2, track section 100 can be joined to another track section 100' to form a track T. The track T can be placed on a generally planar support surface. For example, the support plane S defined by lower surface 140 is parallel to and in engagement with the support surface. In FIG. 2, track section 100' is identical to track section 100, and has been oriented so that its coupling portion 120' is engaged with coupling portion 120. Coupling portions 120 and 120' provide a mating interface between track sections 100 and 100'.

Coupling portions 120 and 120' can perform several related functions. First, they can provide a transition between the upper surfaces 130 and 130' of each track section, so that track T appears to have a continuous upper surface. Second, they provide a mechanical interlock between track sections 100 and 100', which resists or inhibits relative lateral (to the lengthwise axes of the track sections) movement of the track sections 100 and 100'. Third, coupling portions 120 and 120' can provide a connection (whether a mechanical interlock or otherwise) between track sections 100 and 100', which resists or inhibits relative non-lateral movement of the track sections 100 and 100'.

Coupling portion 120 is preferably configured so that it can brought into coupling engagement with a similar or identical coupling portion 120' along a range of directions, each having an directional component IP that is parallel to the support plane S ("in plane") and a directional component OP that interests the support plane S ("out-of-plane"). Thus, the direction of engagement can have a non-zero component parallel to the support plane S and a non-zero component intersecting the support plane S.

Figure 3A:
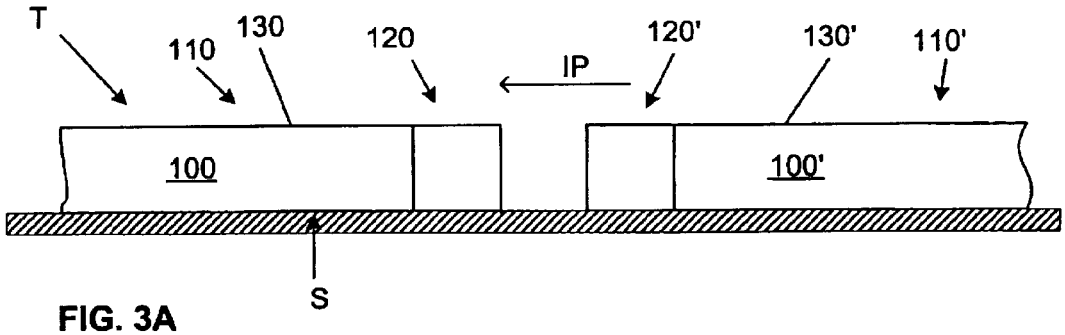
FIGS. 3A and 3B schematically illustrate the track sections of FIG. 2 being moved into coupling engagement from two different directions.

As shown in FIG. 3A, coupling portion 120' can be moved into coupling engagement with coupling portion 120 along a direction having a directional component along axis IP, which is oriented parallel to support plane S. Axis IP may also be, but as explained below is not necessarily, parallel to a longitudinal axis of the track sections 100 and 100'.

Figure 3B:
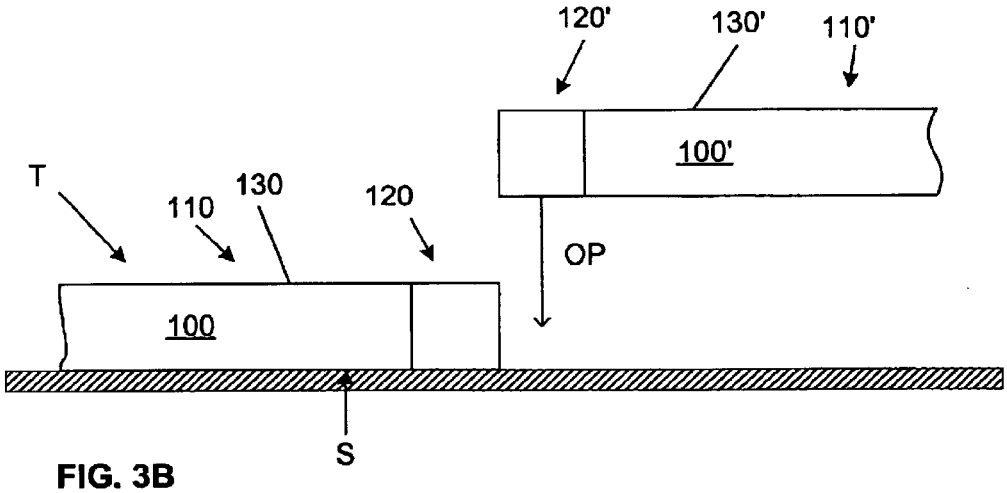

As shown in FIG. 3B, coupling portion 120' can be moved into coupling engagement with coupling portion 120 along a direction with a directional component along OP, which is oriented in a direction non-parallel to support plane S. In this example, the axis OP is perpendicular to support plane S and perpendicular to the planar upper surface 130 of traction section 100.

Figure 4A:
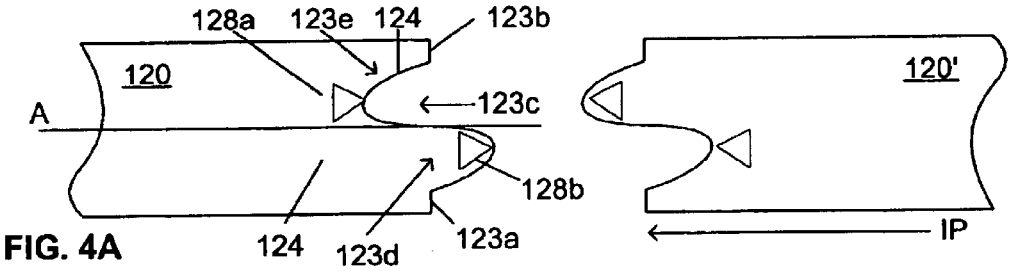
FIGS. 4A–4C schematically illustrate an embodiment of a coupling portion of a track section according to the invention.
Figure 4B:
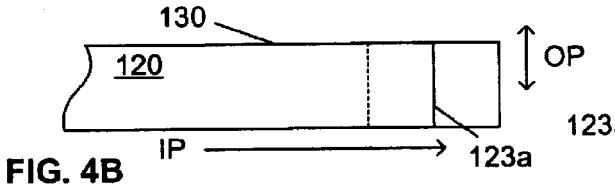
Figure 4C:
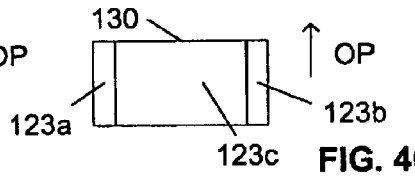
Figure 5A:
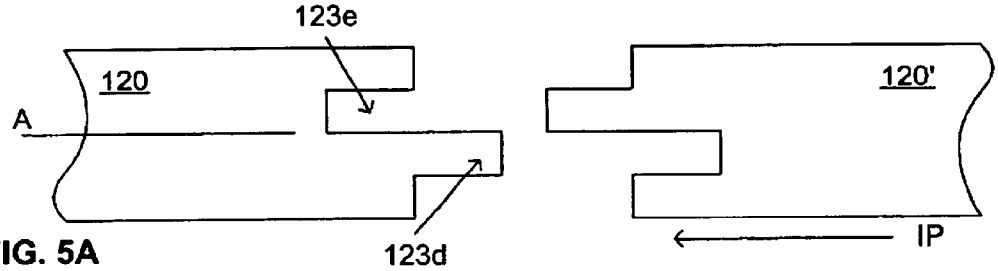
FIGS. 5A–5C schematically illustrate another embodiment of a coupling portion of a track section according to the invention.
Figure 5B:
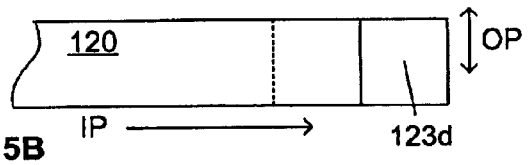
Figure 5C:
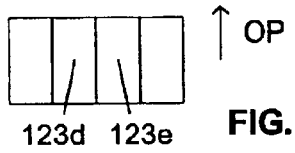

Coupling portion 120 can be configured with many different geometries. Several representative geometries are illustrated schematically in FIGS. 4A–8C. The embodiment shown schematically in FIGS. 4A–4C is used to further describe some of the general principals of a coupling portion 120. Coupling portion 120 has an outer, or coupling, end 123. Coupling end 123 has a contoured shape that, when viewed from above, is symmetrical about central, longitudinal, or symmetry axis A of track section 100.

Thus, the coupling end of an identically configured coupling portion 120' on a similar track section 100' is parallel to coupling end 123 when the two track sections 100 and 100' are disposed with their axes A aligned coaxially and their coupling portions 120 and 120' facing each other. The contoured shape of coupling end 123 can include right and left shoulder portions 123*a* and 123*b*, and a central portion 123*c* that includes a projection 123*d* and a recess 123*e*. The end face of coupling end 123 forms end wall 124, which is perpendicular to axis A, in that the upper edge of the end wall 124 is disposed directly above the lower edge of the end wall 124.

The configuration of coupling end 123 permits coupling portions 120 and 120' to be brought into engagement by relative movement in a direction having a component along axis IP and a component along axis OP. In this embodiment, axis IP is shown as being parallel to axis A of track section 100 (and to support plane S), and axis OP is shown as being perpendicular to axis IP (and to support plane S).

The mechanical interlock formed by the inter-engagement of coupling end 123 and the mating coupling end on coupling portion 120' provides resistance to forces applied laterally to track sections 100 and 100' that would tend to move the track sections 100 and 100' out of alignment either laterally (with respect to axis A) or otherwise in any direction other than along axes IP or OP.

Coupling portions 120 and 120' may be held in engagement with each other, for example, resisting relative movement of the coupling portions 120 and 102' away from each other along axes IP or OP, by a variety of mechanisms. In the embodiment illustrated in FIGS. 4A–4C, retention mechanisms 128*a* and 128*b* are illustrated schematically as being associated with projection 123*d* and recess 123*e*. Retention mechanisms 128*a* and 128*b* engage or interact with each other to resist relative movement with respect to each other. These mechanisms may be mechanical interlocks (such as projections and recesses, latches, detents, etc.), other mutually attractive mechanisms such as magnets with their opposite poles facing outwardly, or frictional engagement between the sides of projection 123*d* and recess 123*e* on mating coupling portions 120 and 120'.

Figure 6A:
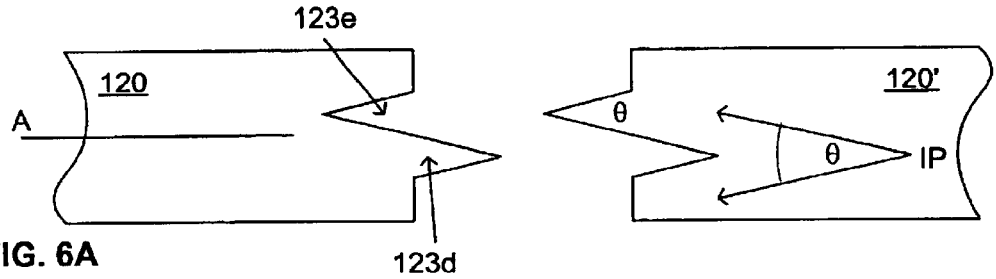
FIGS. 6A–6C schematically illustrate another embodiment of a coupling portion of a track section according to the invention.
Figure 6B:
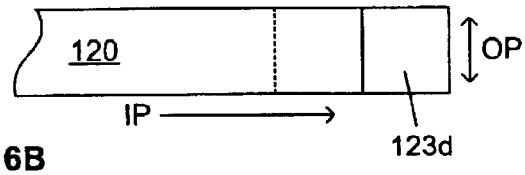
Figure 6C:
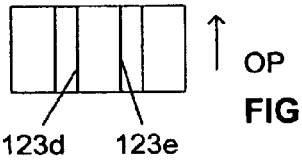

Axis IP may be oriented in a plane parallel to support plane S in a range of angles with respect to axis A, depending on the contour of coupling end 123, and in particular, of the projection 123*d* and recess 123*e*. In the embodiment illustrated in FIGS. 4A–4C, a relatively wide range of angles is enabled by the converging, arcuate sides of projection 123*d* and recess 123*e*. In the embodiment in FIGS. 5A–5C, projection 123*d* and recess 123*e* are rectangular, with parallel sides that are parallel to axis A. Thus, axis IP can only be parallel to axis A. In the embodiment of FIGS. 6A–6C, projection 123*d* and recess 123*e* are triangular, with converging sides. The range of angles θ that axis IP can form with axis A is bounded by the angle θ formed by the converging sides.

Figure 7A:
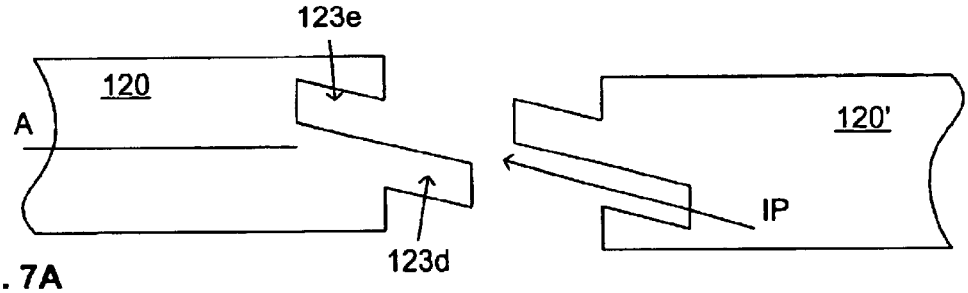
FIGS. 7A–7C schematically illustrate another embodiment of a coupling portion of a track section according to the invention.
Figure 7B:
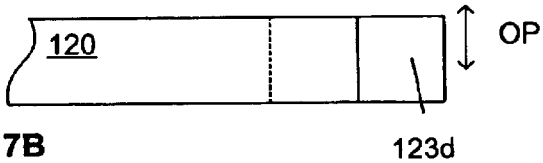
Figure 7C:
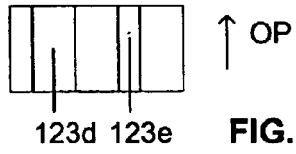

In the embodiment illustrated in FIGS. 7A–7C, projection 123*d* and recess 123*e* are rectangular, with parallel sides, but are oriented at an angle with respect to axis A. Thus, axis IP is also oriented at an angle with respect to axis A.

Axis OP may lie in a plane parallel to axis A and oriented perpendicular to, or at a non-perpendicular angle to, support plane S, and have a range of angles with respect to axis A and to support plane S. In the embodiments illustrated in FIGS. 5A–5C, FIGS. 6A–6C, and FIGS. 7A–7C, axis OP lies in a plane perpendicular to support plane S and can form an angle with respect to support plane S that is a maximum of 90°, since end wall 124 is perpendicular to support plane S. Thus, coupling portion 120' can be brought into coupling engagement with coupling portion 120 along a direction that has an out of plane component as large as 90°.

Figure 8A:
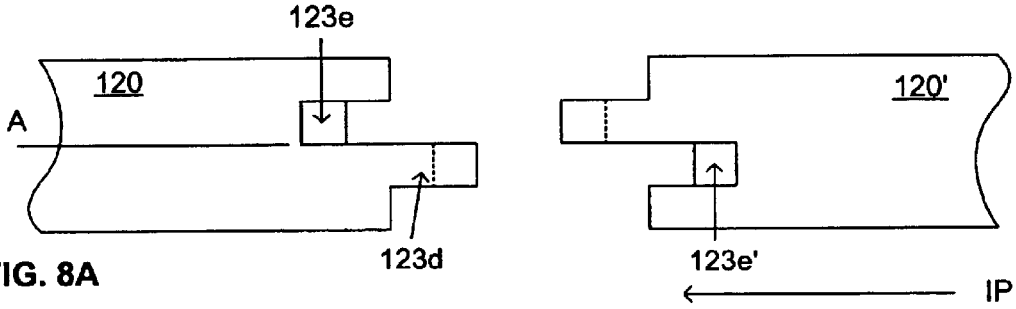
FIGS. 8A–8C schematically illustrate another embodiment of a coupling portion of a track section according to the invention.
Figure 8B:
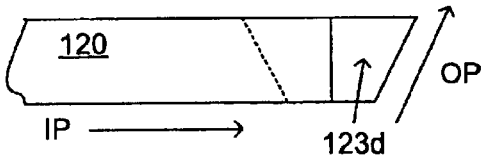
Figure 8C:
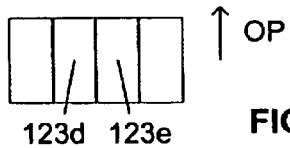

Axis OP may also be limited to having a maximum angle less than 90° with respect to support plane S, as is illustrated in the embodiment shown in FIGS. 8A–8C. In this embodiment the ends of projection 123*d* and recess 123*e* are beveled at an angle with respect to the plane of support plane S. Coupling portion 120' cannot be brought into engagement with coupling portion 120 along an direction perpendicular to the plane of support plane S because the lower end of the bevel on recess 123*e'* would interfere with the top of projection 123*d*. Axis OP thus has a maximum angle with respect to the plane of support plane S that is parallel to the angle of the bevel on the ends of projection 123*d* and recess 123*e*.

Figure 9:
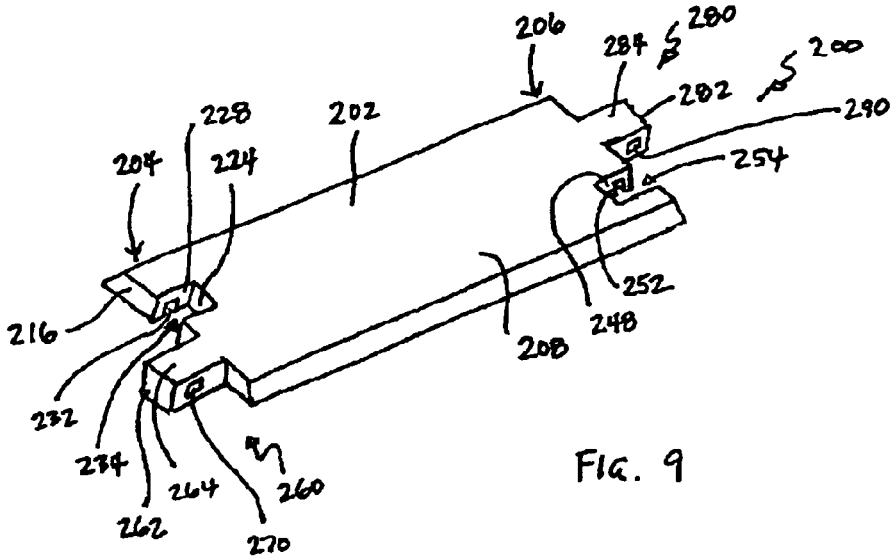
FIG. 9 illustrates a front perspective view of an embodiment of a track section according to the invention.
Figure 10:
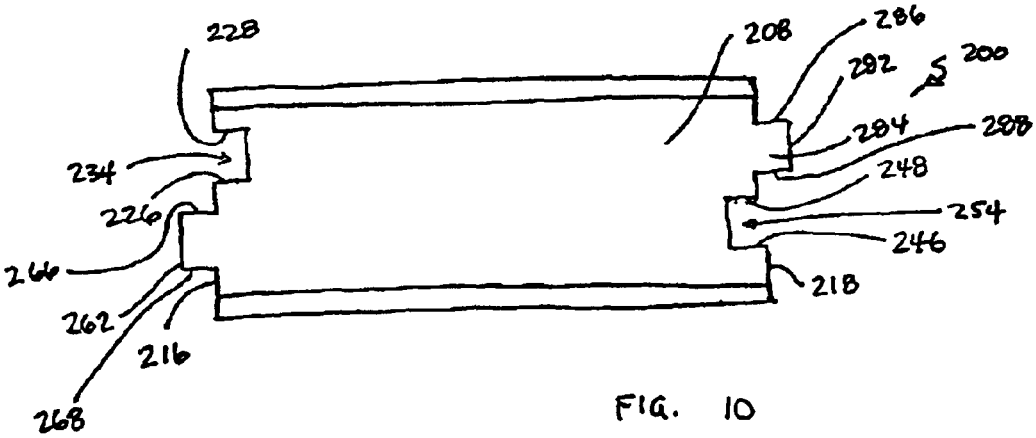
FIG. 10 illustrates a top view of the track section of FIG. 9.
Figure 11:
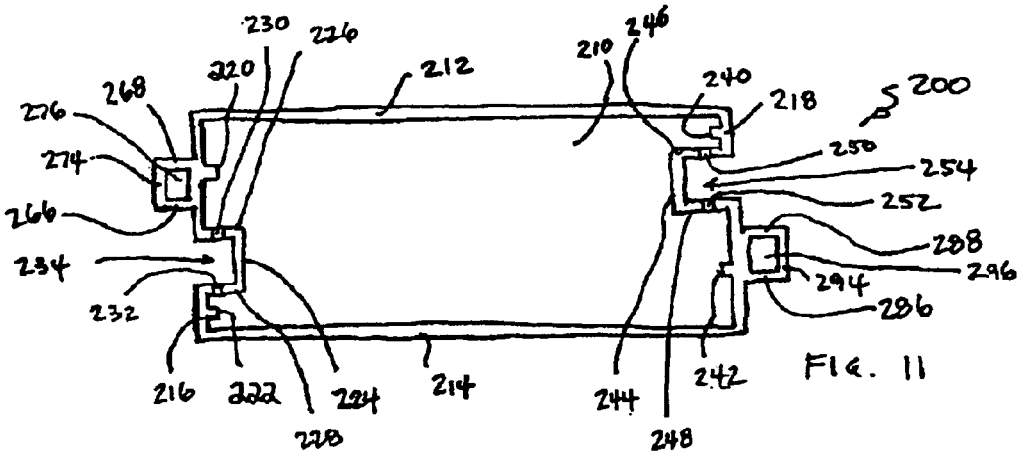
FIG. 11 illustrates a bottom view of the track section of FIG. 9.

An embodiment of a track section according to the invention is illustrated in FIGS. 9–11. In this embodiment, the track section 200 includes a body 202 that has ends 204 and 206. The body 202 includes an upper surface 208 and a lower surface 210 extending between the ends 204 and 206. The body 202 includes tapered side walls 212 and 214 and end walls 216 and 218. Collectively, the lower surface 210 and walls 212, 214, 216, and 218 define a cavity 219 therebetween.

Referring to FIG. 11, the track section 200 includes protrusions 220 and 222 extending inwardly from end wall 216 and protrusions 240 and 242 extending inwardly from end wall 218.

The track section 200 includes a recess portion wall 224 proximate to end 204 and a recess portion wall 244 proximate to end 206. Wall 224 defines a recess 234 in the coupling portion of track section 200 proximate to end 204. As illustrated, recess 234 extends downwardly through the coupling portion and extends from the upper surface to the lower surface of the track section 200. Similarly, wall 244 defines a recess 254 in the coupling portion of track section 200 proximate to end 206. As illustrated, recess 254 extends downwardly through the coupling portion and extends from the upper surface to the lower surface of the track section 200.

The recess portion wall 224 includes side walls 226 and 228 that include slots 230 and 232, respectively. Similarly, the recess portion wall 244 includes side walls 246 and 248 that include slots 250 and 252, respectively.

In the illustrated embodiment, the track section 200 includes a coupling portion 260 proximate to end 204 and a coupling portion 280 proximate to end 206. Coupling portion 260 includes the recess 234 and a projection 262 extending outwardly from the coupling portion 260. Similarly, coupling portion 280 includes the recess 254 and a projection 282 extending outwardly from the coupling portion 280. In one embodiment, projection 262 is substantially symmetrical with recess 234. Similarly, projection 282 is substantially symmetrical with recess 254.

Projection 262 includes an upper surface 264 that is contiguous with the upper surface 208 of the track section 200. Projection 262 has a height that is substantially similar to the height of the body 202. Projection 262 includes side walls 266 and 268 and an end wall 274 that collectively define a cavity 276 therebetween. In one embodiment, the side walls 266 and 268 each includes an opening formed therein. For example, side wall 268 includes opening 270 (see FIG. 9). Side wall 266 includes a similarly sized opening (not shown). The function of the protrusion and the openings in the side walls are discussed below in detail.

Projection 282 includes an upper surface 284 that is contiguous with the upper surface 208 of the track section 200. Projection 282 has a height that is substantially similar to the height of the body 202. Projection 282 includes side walls 286 and 288 and an end wall 294 that collectively define a cavity 296 therebetween. In one embodiment, the side walls 286 and 288 each includes an opening formed therein. For example, side wall 288 includes opening 290 (see FIG. 9). Side wall 286 includes a similarly sized opening (not shown). The function of the protrusion and the openings in the side walls are discussed below in detail.

Projection 262 is configured to be inserted into a corresponding recess on another track section to couple the track sections together. Similarly, projection 282 is configured to be inserted into a corresponding recess on another track section.

As can be appreciated from FIGS. 9–11, the coupling portions 260 and 280 of the track section 100 can be brought together in multiple directions that include one or both of an in plane component and an out of plane component as previously discussed.

Figure 12:
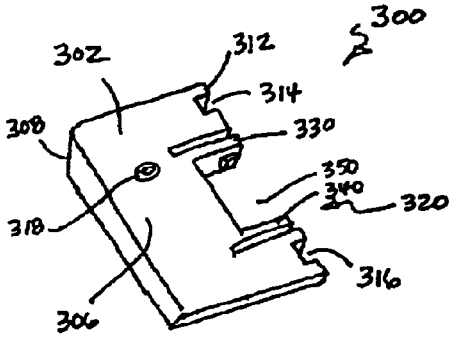
FIG. 12 illustrates a bottom perspective view of an embodiment of a connector according to the invention.
Figure 13:
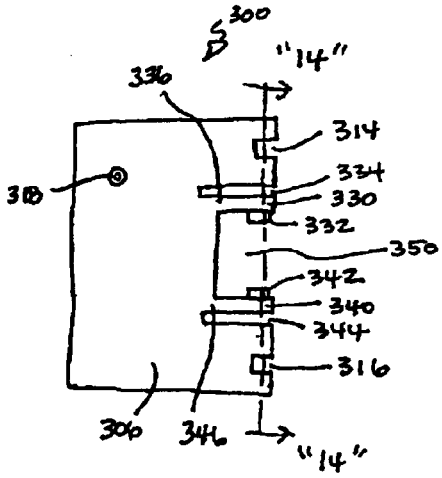
FIG. 13 illustrates a bottom view of the connector of FIG. 12.
Figure 14:
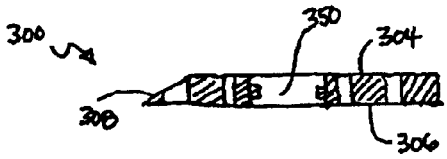
FIG. 14 illustrates a cross-sectional side view of the connector of FIG. 12 taken along the line 14—14.

An embodiment of a connector according to the invention is illustrated in FIGS. 12–14. The connector 300 includes a body 302 that has an upper surface 304 and a lower surface 306. The body 302 includes a tapered side surface 308 and ends 310 and 312. The body 302 also includes an opening 318 formed therein through which a conventional fastener (not shown) can be inserted to couple the connector 300 to a track section.

In one embodiment, the body 302 includes a coupling portion 320 that is configured to engage corresponding components on a track section. The coupling portion 320 includes notches 314 and 316 formed in end 312. The coupling portion 320 also includes first and second connecting portions. The connecting portions include plates or extensions 330 and 340 that extend outwardly from the body 302.

Extension 330 is coupled to the body 302 proximate to its end 336. Extension 330 defines a slot 334 with a portion of the body 302. This arrangement of extension 330 enables the extension 330 to be moved relative to the remainder of the body 302. Similarly, extension 340 is coupled to the body 302 proximate to its end 346. Extension 340 defines a slot 344 with a portion of the body 302. This arrangement of extension 340 enables the extension 340 to be moved relative to the remainder of the body 302.

In the illustrated embodiment, the extensions 330 and 340 define an opening 350. Extension 330 includes a projection or protrusion 332 extending inwardly into the opening 350. Similarly, extension 340 includes a projection or protrusion 342 extending inwardly into the opening 350. Each of the protrusions 332 and 342 is configured to be inserted into a corresponding slot 250 or 252 in walls 246 and 248 of track section 200. The protrusions 332 and 342 extend into the recess 254 defined by the track section.

Figure 15:
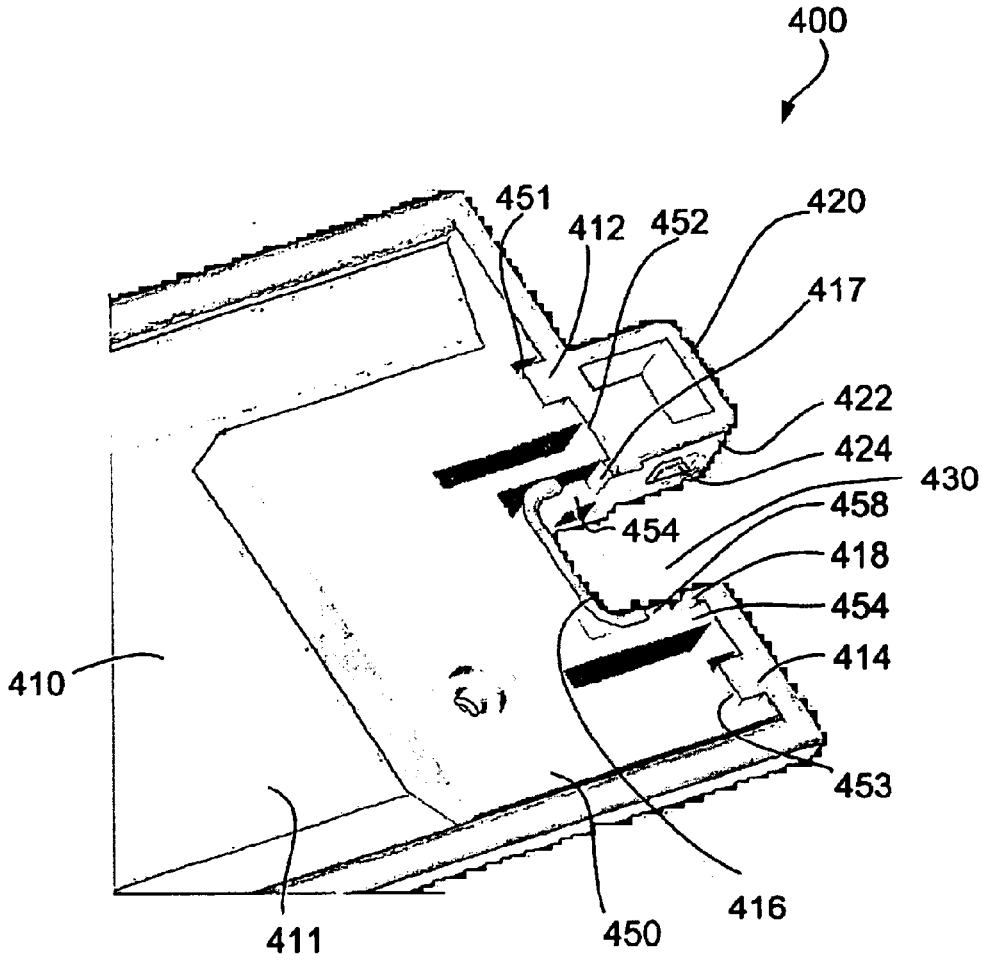
FIG. 15 illustrates a bottom perspective view of a track section and a connector in an assembled configuration.

An embodiment of an assembled connector and track section is illustrated in FIG. 15. In this embodiment, the track section 400 includes a body 410 and a connector 450 coupled to the body 410. The connector is slid into place on the body 410 and can be retained in place via friction. In an alternative embodiment, the connector can be coupled to the body 410 via a connector or other coupling mechanism or method, including an adhesive, a solvent, or welding.

As illustrated, when the connector 450 is placed into contact with the lower surface 411 of the body 410, notches 412 and 414 on the body 410 frictionally engage slots 451 and 453 in the connector 450. Similar to track section 200, the body 410 includes a recess portion wall 416 that has two slots 417 and 418 defined therein.

The connector 450 is positioned so that each of the protrusions or projections or extensions 454 and 458 on the connector 450 engages one of the slots 417 and 418 and extend through the recess wall. The protrusions 454 and 458 are configured to extend inwardly through the slots 417 and 418 and into the recess 430 defined by the recess portion wall 416.

In this embodiment, the body 410 includes a protrusion 420 extending outwardly from one end. The protrusion 420 can be inserted into a recess on another track section. The protrusion 420 includes a side wall 422 that defines an opening 424 therein. In another embodiment, each of the side walls of the protrusion can include openings.

When a projection 420 is inserted into a recess on another track section, such as recess 430, the protrusions extending into the recess engage corresponding openings in the side walls of the projection 420. The engagement of the protrusions into the openings provides a coupling force for the track sections. As discussed above, the track sections can be brought together in several directions that include either or both an in plane component and an out of plane component to insert the protrusion into the corresponding recess on another track section.

In the illustrated embodiment, the track sections that are coupled together can be separated by twisting the track sections relative to each other to disengage the projection from a recess. In another embodiment, the track sections can be pulled in different directions relative to each other to disengage a protrusion from an opening on the projection.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A toy track section comprising:

a body, said body including:

an upper surface;

a lower surface; and a coupling portion disposed at an end of said body and having an upper surface substantially contiguous with said body upper surface, said coupling portion including a projection extending outwardly from said coupling portion and having a recess extending inwardly into said coupling portion, said recess extending downwardly through said coupling portion; and a connector, said connector being coupled to said lower surface of said body;

said connector including a body, a first connecting portion coupled to said body, and a second connecting portion coupled to said body, said first connecting portion including a first projection, and said second connecting portion including a second projection.

2. The toy track section of claim 1, said projection including a first side and a second side opposite said first side, said first side including an opening formed therein, and said second side including an opening formed therein, said openings being configured to be engaged by a coupling portion of another track section.

3. The toy track section of claim 2, said recess including a wall defining a portion of a perimeter thereof, said wall including a first side portion and a second side portion opposite said first side portion, and each of said first side portion and said second side portion including a projection extending therefrom, said projections being configured to engage openings on a projection of a coupling portion of another track section.

4. The toy track section of claim 1, said projection having a configuration, said recess having a configuration, said recess configuration being substantially symmetrical with said projection configuration.

5. The toy track section of claim 1, said first connecting portion including a first plate movably coupled to said body, said first projection being disposed on said first plate.

6. The toy track section of claim 5, said second connecting portion including a second plate movably coupled to said body, said second projection being disposed on said second plate, said first plate and said second plate being configured to move said first projection and said second projection in opposite directions.

7. The toy track section of claim 1, said recess including a wall defining a portion of a perimeter of said recess, said wall including a first side portion and a second side portion opposite said first side portion, each of said first side portion and said second side portion including an opening formed therein, said first projection of said connector extending through said opening of said first side portion, and said second projection of said connector extending through said opening of said second side portion.

8. A track assembly for a toy vehicle, the track assembly comprising:

a first track element, said first track element including a first end, a second end, an upper surface, a lower surface, and a coupling portion located proximate to said first end, said coupling portion including a projection and a recess, said recess extending through said upper and lower surfaces of said first track element, said projection including a first side and a second side opposite said first side, said first side including an opening formed therein, said second side including an opening formed therein, said first track element including a wall defining a perimeter of said recess, said wall including a first side portion and a second side portion opposite said first side portion, each of said first side portion and said second side portion including a projection extending therefrom; and a second track element, said second track element including a first end, a second end, an upper surface, a lower surface, and a coupling portion located proximate to its first end, said coupling portion of said second track element including a projection and a recess, said second track element recess extending through said upper and lower surfaces of said second track element, said coupling portion of said first track element being configured to be coupled to said coupling portion of said second track element in a first orientation and in a second orientation, said first orientation being different from said second orientation; and a first connector, said first connector being coupled to said lower surface of said first track element, said first connector including a first body, a first connecting portion, and a second connecting portion, said first connecting portion including a first resilient plate coupled to said first body and having a first projection extending therefrom, said second connecting portion including a second resilient plate coupled to said first body and having a second projection extending therefrom, said first resilient plate and said second resilient plate being configured to move said first projection and said second projection in opposite directions with respect to said first body; and a second connector, said second connector being coupled to said lower surface of said second track element, said second connector including a second body, a third connecting portion, and a fourth connecting portion, said third connecting portion including a third resilient plate coupled to said second body and having a third projection extending therefrom, said fourth connecting portion including a fourth resilient plate coupled to said second body and having a fourth projection extending therefrom, said third resilient plate and said fourth resilient plate being configured to move said third projection and said fourth projection in opposite directions with respect to said second body.

* * * * *

UNITED STATES PATENT AND TRADEMARK OFFICE

CERTIFICATE OF CORRECTION

PATENT NO. : 6,883,719 B2
DATED : April 26, 2005
INVENTOR(S) : Pyrce

It is certified that error appears in the above-identified patent and that said Letters Patent is hereby corrected as shown below:

Column 2,
Line 32, "portion 10" should be -- portion 110 --.

Signed and Sealed this

Sixteenth Day of August, 2005

JON W. DUDAS
*Director of the United States Patent and Trademark Office*